United States Patent [19]

Marshall et al.

[11] 4,177,580

[45] Dec. 11, 1979

[54] LASER MARKSMANSHIP TARGET

[75] Inventors: Albert H. Marshall, Maitland; George A. Siragusa, Winter Park, both of Fla.

[73] Assignee: The United States of America as represented by the Secretary of the Navy, Washington, D.C.

[21] Appl. No.: 871,265

[22] Filed: Jan. 23, 1978

[51] Int. Cl.[2] ..... F41G 3/26; F41J 5/08

[52] U.S. Cl. ..... 35/25

[58] Field of Search ..... 35/25; 273/101.1, 101.2, 273/102.1 R, 102.1 C, 102.1 F, 102.2 R, 102.2 B, 102.2 S

[56] References Cited

U.S. PATENT DOCUMENTS

| | | | |
|---|---|---|---|
| 3,352,556 | 11/1967 | Chaskin | 35/25 X |
| 3,588,108 | 6/1971 | Ormiston | 273/101.1 |
| 3,811,204 | 5/1974 | Marshall et al. | 273/101.1 X |
| 3,898,747 | 8/1975 | Marshall | 273/101.1 X |
| 3,964,178 | 6/1976 | Marshall et al. | 273/101.1 X |
| 4,065,860 | 1/1978 | Linton et al. | 273/101.1 X |
| 4,083,560 | 4/1978 | Kikuchi et al. | 273/101.1 X |

*Primary Examiner*—Vance Y. Hum

*Attorney, Agent, or Firm*—Richard S. Sciascia; Robert W. Adams; David S. Kalmbaugh

[57] ABSTRACT

A target system is disclosed which is responsive to and indicative of the hits and areas of near miss of laser light pulses that have been shot from a laser weapon aimed at the target system, be it a simulated gun or other device, by a marksman. In addition to the bullseye indicia on the face of the target system, the target system comprises a quadrant arrangement of laser light detectors that are located on the front of the target system in such manner as to permit them to sense the laser light pulses. The detectors are connected in unique combination with data processing channels, programmed timers, a preprogrammed read only memory logic circuit, and an array of lights disposed around and near the perimeter of the target face. The latter mentioned lights light up in accordance with the approximate location of the hits of the laser light pulses relative to the bullseye of the target face, thereby indicating either a hit or the direction of a near miss to the marksman.

19 Claims, 4 Drawing Figures

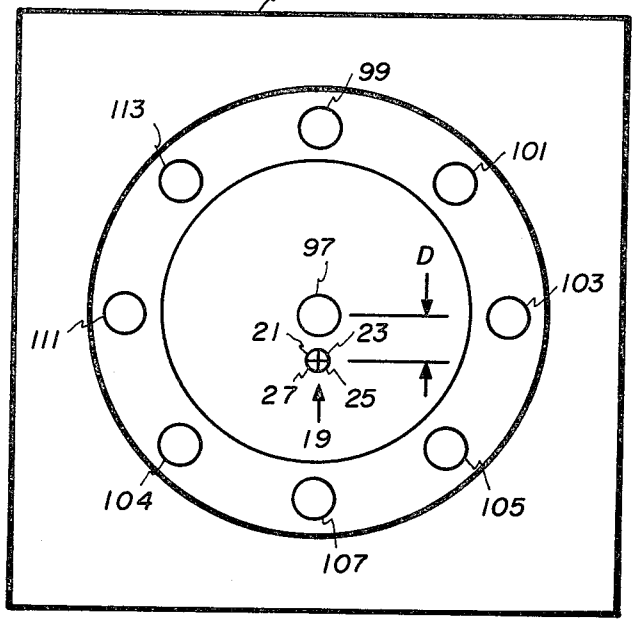
FIG. 3
ROM TRUTH TABLE
| IND. LIGHTS | TARGET HIT INDICATOR LIGHT POSITIONS | SENSOR QUADRANT AND DATA CHANNELS | | | |
|---|---|---|---|---|---|
| | | I | II | III | IV |
| 97 | HIT | 1 | 1 | 1 | 1 |
| 101 | HIGH RIGHT | 0 | 1 | 0 | 0 |
| 113 | HIGH LEFT | 1 | 0 | 0 | 0 |
| 99 | HIGH | 1 | 1 | 0 | 0 |
| 109 | LOW LEFT | 0 | 0 | 0 | 1 |
| 105 | LOW RIGHT | 0 | 0 | 1 | 0 |
| 111 | LEFT | 1 | 0 | 0 | 1 |
| 103 | RIGHT | 0 | 1 | 1 | 0 |
| 107 | LOW | 0 | 0 | 1 | 1 |
FIG. 2
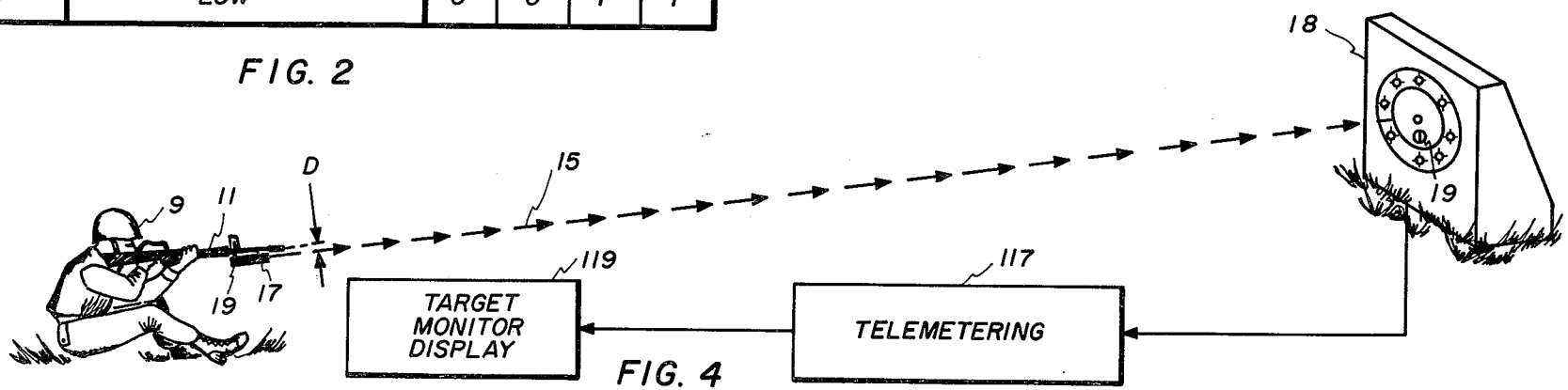
FIG. 4

LASER MARKSMANSHIP TARGET

Field of the Invention

The present invention, in general, relates to training simulators and, in particular, constitutes a target that indicates the approximate locations of "hits" made thereon relative to the bullseye thereof by pulses of laser light eminating from a laser gun being fired thereat by a practicing marksman.

DESCRIPTION OF THE PRIOR ART

Heretofore, numerous light responsive targets have been used in shooting galleries and other places. As a matter of fact, such targets are so copious in quantity that further discussion thereof is ostensively unnecessary at this time. Thus, suffice to say that there are some general similarities between them and the subject invention, but the structures and functions thereof are quite different and a considerable improvement thereover.

U.S. Pat. No. 3,964,178 to Albert H. Marshall (one of the inventors of this invention), Frank J. Oharek, John H. Dillard, and Robert J. Entwistle is the closest known prior art of the instant invention. A universal infantry weapons trainer is disclosed therein in which frames of motion picture film are employed to produce simultaneously from one set of frames a background area which includes a target and, from another set of frames, an infrared lead aim spot. The sets of film frames are coordinated in projection and in a desired degree of nonregistration between the lead spot and the target, so as to provide a lead in the infrared spot that is representative of the correct lead and an indication of whether or not a weapon is properly aimed. Also disclosed is a receiver circuit comprising a quadrant arrangement of infrared detectors for sensing the infrared lead aim spot combined with amplifiers, comparators, logic and means for indicating a bullseye "hit" on a target or a specific area of near miss relative to the target on the field of view displaying it.

Unfortunately, the aforementioned devices of the prior art ordinarily leave something to be desired, especially from the standpoints of accuracy, complexity, and target information efficiency. Moreover, with respect to the former, sophistication—and, hence, the quality—thereof only need be that which is sufficient for entertainment purposes—that is, they only need to provide hit or miss indications—while the latter is complex, does not operate exactly the same as the subject invention, and contains a combination of elements that is somewhat different from that of the present invention.

Of course, there are other laser gun training targets presently in existence; however, insofar as is known, most thereof only provide hit or miss indications, like the aforementioned hit or miss indicating entertainment types found in shooting galleries.

SUMMARY OF THE INVENTION

The subject invention overcomes some of the disadvantages of the prior art, including those mentioned above, in that it comprises a relatively simple target system which is responsive to laser light pulses from a laser gun (which simulates a real gun for target practice and training purposes), rather than being responsive to ordinary light or other less coherent, concentrated, and intense types of radiant energy. Consequently, it is far more sensitive which, in turn, makes it far more efficient and accurate in its response. Thus, vastly improved marksmanship is the result of the use thereof for any given expenditure of time and money, as far as the training of human marksmen is concerned.

Included in the subject target is the capability of indicating near misses and the respective areas thereof, as well as direct hits. Incorporated therein for such purposes is a multiple unit laser light sensor incorporating four photodiodes disposed in a predetermined geometrically arranged pattern, the entire pattern of which is located at a significant position with respect to the center or bullseye of the target. As will be discussed more fully below, the pattern of photodiodes has been selected to sense certain different areas of the target, and the disposition thereof selected to be in such direction and at such distance from the center of the target as will effect compensation for the displacement of the center of the laser from the longitudinal axis of the barrel of the gun. When uniquely combined with amplifiers, timers, comparators, latches, a read only memory, other logic components, directionally oriented hit and miss indicator lights, and target indicia, the sensor unit, in such combination, forms an unusual target system which enables the practicing marksman to not only determine if he has hit or missed the bullseye of the target but also enables him to know in what direction he has missed the bullseye thereof, thereby facilitating his correcting his shooting errors, so as to make him a better shot in a shorter period of time and with less expense.

In view of the foregoing, it should be readily apparent that a paramount object of this invention is to provide a new and improved marksman's practice shooting target.

Another object of this invention is to provide an improved laser light responsive target.

Still another object of this invention is to provide an improved laser light responsive target which will indicate both "hits" and the areas of near "misses".

A further object of this invention is to provide a new and unique target simulator.

Another object of this invention is to provide an improved marksmanship training system.

Another object of this invention is to provide an improved laser gun—target system which will facilitate the training of marksmen more expeditiously and safely than heretofore.

Another object of this invention is to provide a more reliable laser light responsive target that is easily and economically constructed, maintained, and used because it is susceptible to having solid state components incorporated therein.

Another object of this invention is to provide an improved means for easily and efficiently monitoring the shooting accuracy of a laser gun marksman, from afar and/or from nearby, and by the marksman himself and/or by others, as warranted by preferred operational circumstances.

Other objects, advantages and novel features of the invention will become apparent from the following detailed description of the invention when considered in conjunction with the accompanying drawing wherein:

BRIEF DESCRIPTION OF THE DRAWING

FIG. 2 depicts the truth table of the Read Only Memory (ROM) incorporated in the system of FIG. 1;

FIG. 3 is a diagramatical representation of the front face of the target of the system of FIG. 1; and FIG. 4 is a pictorial representation of a typical situation in which the subject invention may be used to an advantage.

DESCRIPTION OF THE PREFERRED EMBODIMENT

Figure 1:
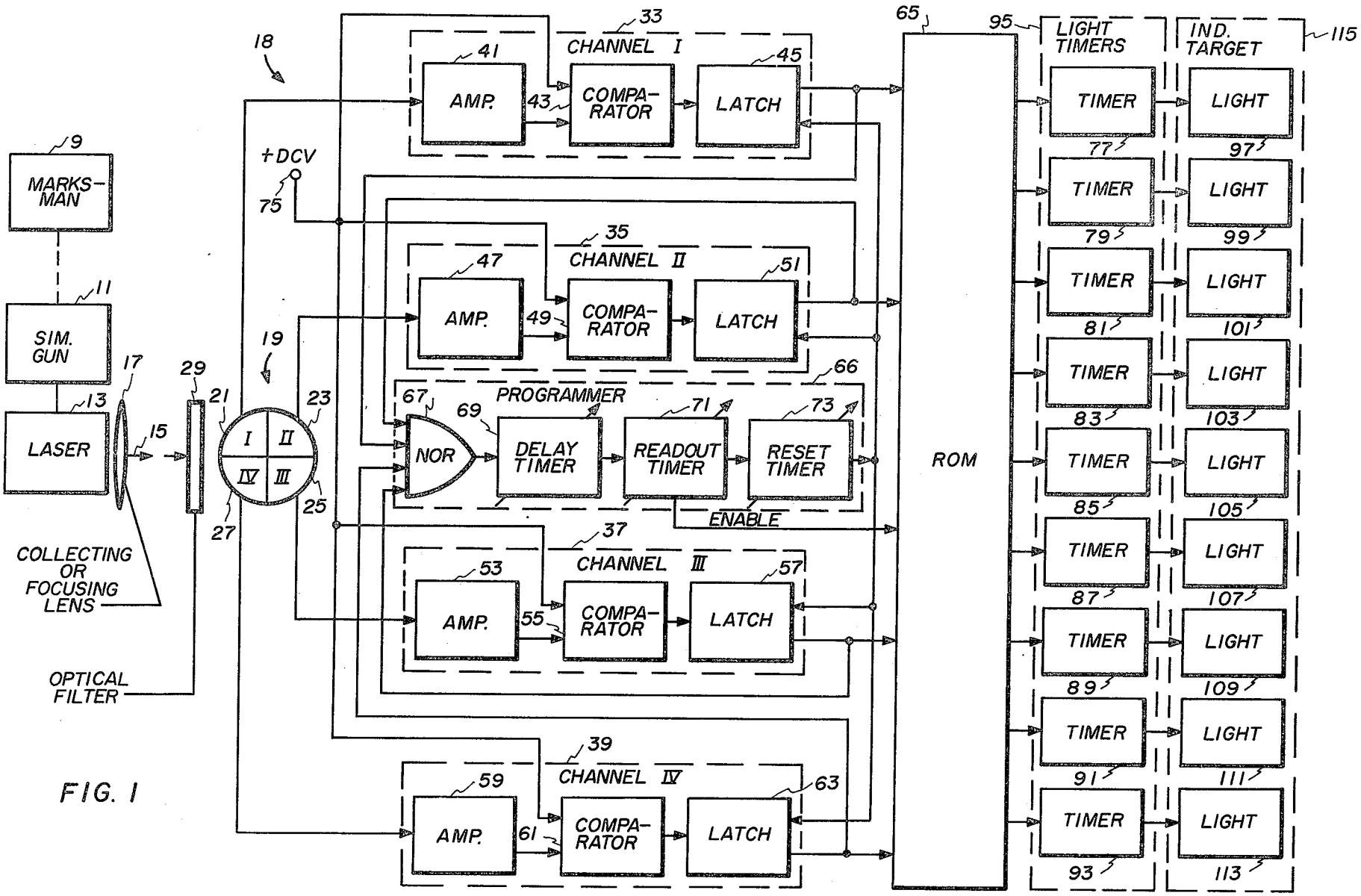
FIG. 1 is a block diagram of the system constituting the subject invention.

The preferred embodiment of the subject invention will now be discussed in some detail in conjunction with all of the figures of the drawing, wherein like parts are designated by like reference numerals, insofar as it is possible and practical so to do.

Referring now to FIG. 1, there is shown a marksman 9, which, of course, may be any human marksman trainee or otherwise. Marksman 9 is schematically depicted as holding a fake or simulated gun 11, which, of course, may be of any type which simulates the weapon on which marksman 9 is to be trained. Physically attached to the barrel of gun 11 is a laser 13 adapted for shooting pulses of laser light 15 through a collecting or focusing lens 17 in response to the pulling of the trigger thereof by marksman 9. Collecting or focusing lens 17 is preferably a 90 mm focal length, 20 mm diameter lens that is mounted in a suitable conventional manner on the front end of laser 13, so that it will effectively concentrate laser light 15 into a small substantially point-like spot prior to its traveling on toward whatever gun 11 is aimed at.

As will be discussed more fully below, marksman 9 is shooting his laser gun at an improved target 18 comprising the remainder of the invention. In this particular preferred embodiment, target 18 incorporates a plurality of laser light sensors 19, herewith defined as being four photodiodes 21, 23, 25, and 27, respectively.

Disposed in front of photodiodes 21, 23, 25, and 27 is an optical filter 29 which is employed to delete spurious radiant energy, such as, for example, bright sunlight and glare. Obviously, it would be well within the purview of one skilled in the art having the benefit of the teachings presented herewith to design collecting or focusing lens 17 and optical filter 29 in such manner that they may be properly mounted in front of the optical output of laser 13 and the optical input surface of photodiodes 21 through 27, respectively.

The respective outputs of photodiodes 21 through 27 are connected to the inputs of four data processing channels, herewith referenced by reference numerals 33, 35, 37, and 39, respectively.

The output of photodiode 21 is, for example, connected to the input of an amplifier 41, the output of which is connected to one of the inputs of a comparator 43, the output of which is connected to the input of a latch 45, and as may readily be seen, said three elements consitute channel I of the invention.

The output of photodiode 23 is connected to the input of an amplifier 47, the output of which is connected to one of the inputs of a comparator 49, with the output thereof connected to the input of a latch 51. Again, the aforesaid three elements constitute channel II of the invention.

The output of photodiode 25 is connected to the input of an amplifier 53, the output of which is connected to one of the inputs of a comparator 55, with the output thereof connected to the input of a latch 57 which, of course, constitutes channel III of the invention.

The output of photodiode 27 is connected to the input of an amplifier 59, the output of which is connected to one of the inputs of a comparator 61, with the output thereof connected to the input of a latch 63, the latter three elements of which constitute channel IV of the invention.

Although herein defined as latches 45, 51, 57, and 63, it would perhaps be noteworthy that they are, in fact, the types of flipflops or bistable multivibrators which have been designed in accordance with their intended purposes.

The respective outputs of latches 45, 51, 57, and 63 are connected to compatible inputs of a read only memory (ROM) 65 that has been preprogrammed in accordance with the truth table illustrated in FIG. 2, and which, for instance, may be a Model 82S23B ROM manufactured by Signetics, Inc., Sunnyvale, California.

The output of latch 45, of course, constitutes the output of channel I and is connected to one of the inputs of a NOR gate 67; the output of latch 51, of course, is, in fact, the output of channel II and is likewise connected to one of the inputs of NOR gate 67; the output of latch 57 is, of course, the output of channel III and is likewise connected to one of the inputs of NOR gate 67; and the output of latch 63, of course, constitutes the output of channel IV and is connected to the remaining input of NOR gate 67. The output of NOR gate 67 is connected to the input of an adjustable delay timer 69, the output of which is connected to the input of an adjustable readout timer 71, with the data outputs thereof connected to the input of an adjustable reset timer 73. The enable output of readout timer 71 is connected to the "dump" input of read only memory 65. The output of adjustable reset timer 73 is connected to the reset inputs of latch 45, latch 51, latch 57, and latch 63.

For reasons which will be discussed in more detail below, the other inputs of comparators 43, 49, 55, and 61 are interconnected and are connected to a positive direct current voltage 75.

Read only memory 65 has nine outputs which are respectively connected to the inputs of preset timers 77, 79, 81, 83, 85, 87, 89, 91, and 93, all of which constitute a plurality of light timers 95. The outputs of timers 77 through 93 are respectively connected to the inputs of lights 97, 99, 101, 103, 105, 107, 109, 111, 113 which, in this particular case, constitute target indicator lights 115.

Referring now to FIG. 3, a more detailed illustration of the front face of the target portion 18 of this invention is presented. For purposes of clarity, it would appear to be noteworthy that light 97 is located in the center or effective bullseye thereof, while lights 99 through 113 are disposed substantially around and near the outer periphery of the circular indicia portion of the subject target. It is also of significance that the four photodiodes 21 through 27 are disclosed in a substantially square pattern, as far as sensors 19 are concerned.

Photodiode 21 constitutes the top left one, photodiode 23 constitutes the top right one, photodiode 25 constitutes the bottom right one, and photodiode 27 constitutes the bottom left one. Also of significance, and worthy of note at this time, is the fact that the center of the pattern of photodiodes 21, 23, 25, and 27 is located a predetermined distance D below the center of the bullseye of the target, herewith indicated by light 97.

Considering now the pictorial illustration of FIG. 4, it may readily be seen that marksman 9 is shown as holding and firing laser gun 11. In this particular portrayal, however, laser gun 11 is a laser rifle, and below the barrel thereof a laser 13 is mounted. In this particular instance, laser rifle 11 is being fired by marksman 9 and, hence, pulses or bursts of laser light 15 are shown as traveling toward target 18.

Because the data signals are present at target 18 which turn on indicator lights 97 through 113 in accordance with the aiming of rifle 11, they may also be connected through any suitable predetermined telemetering system 117 to a target monitor display 119, which may be disposed in proximity with marksman 9 and/or other observers (not shown), as desired. Obviously, although not shown in FIG. 4, as many telemetering systems and target monitor displays may be used as necessary to facilitate the training of marksman 9 by instructors or others located in the vicinity thereof, or even located at some place remote therefrom .

At this time, it would ostensively be noteworthy that all of the elements shown in FIGS. 1, 3, and 4 which make up this invention are well known, conventional, and commercially available. Therefore, it should be understood that it is their unique interconnections and interactions which effect the subject invention and cause it to produce the aforementioned new and unique results.

Mode of Operation

The operation of the invention will now be discussed briefly in conjunction with all of the figures of the drawing.

Referring first to FIG. 4, it may readily be seen that marksman 9 is sitting on the ground and shooting at target 18. Gun 11, which he is firing in this particular instance, is a laser rifle which shoots a pulse of laser light 15 toward target 18 every time the gun's trigger is pulled. Of course, laser rifle 11 could, without limitation, be any other type gun or device and, furthermore, could be an automatic weapon which fires a burst of laser light pulses every time the trigger is pulled, if so desired. And, of course, regardless of the type of laser gun, rifle, or weapon it is, it is one that simulates a comparable real one.

As shown, laser 13 that actually shoots laser light pulses 15 is mounted underneath the gun barrel at some distance D therefrom, so that a shooting error would occur, if it were not compensated in target 18. As best seen in FIG. 3, photodiodes 21, 23, 25, and 27 form a quadrant-like pattern, the center of which is located distance D from the center of indicator light 97, the latter of which is located in the center of the bullseye of the target. Hence, because distances D of FIG. 3 and FIG. 4 are identical, the aforementioned error compensation is effected for most practical purposes.

As laser light 15 is received by target 18 due to rifle 11 having been aimed thereat and fired by marksman 9, one or more of the photodiodes are activated thereby, depending on the accuracy of the shot. For example, if there were a bullseye hit, all four of photodiodes 21, 23, 25, and 27 would be optically activated and, thus, produce electrical signals at the outputs thereof that are susceptible to further data processing; and if the shot were, say, high and to the right, then only photodiode 23 would be optically activated. Depending on which photodiodes were activated, data processing channels I, II, III, and/or IV would be activated in correspondence thereto.

Because all of the aforesaid four channels operate in exactly the same way, for the sake of keeping this disclosure as simple as possible, only one thereof will be described. Hence, for such purpose, let it be assumed that photodiode 23 has been activated because marksman 11's shot has been high and to the right, instead of on target dead center. In such case, only channel II would be enabled because only photodiode 23 would have produced an electrical signal at the output thereof.

Within channel II, the data processing channel associated with photodiode 23, the output signal therefrom is amplified to a more useful voltage level by amplifier 47 before it is supplied to comparator 49 for comparison with a predetermined positive direct current voltage (+DCV), the voltage of which has been selected to set a desired threshold level before being enabled. Thus, it may be seen that comparator 49 acts as a thresholder which effectively prevents the processing of photodiode signals that are less than some preset voltage. Such thresholding, of course, prevents spurious or relatively high light conditions from inadvertently enabling the invention and, thus, giving a false reading.

When the input signal to comparator 49 exceeds the threshold positive direct current voltage 75, a pulse occurs at the output thereof which triggers latch 51 from an inactive "0" state to an active "1" state, since, as previously indicated, latch 51 is a properly designed flipflop or bistable multivibrator. Hence, as best seen in the truth table of FIG. 2, when a 0, 1, 0,0 word is supplied to the data inputs of read only memory (ROM) 65 by the outputs of the channel latches—in this case, the "1" being from latch 51 of channel II—the output of said ROM 65 supplies a suitable signal to indicator light 101 via timer 81, thereby turning it on and leaving it on for whatever period of time facilitates the observing thereof by marksman 9, the time period of which is controlled by the proper predesign or presetting of timer 81.

As previously mentioned, ROM 65 is preferably a Model 82S23B, manufactured by Signetics, Inc. of Sunnyvale, California, and, consequently, it is or may be preprogrammed in accordance with the programming depicted in the truth table of FIG. 2, inasmuch as so doing by the artisan is well known and conventional in the ROM art. Therefore, the indicator lights of target 18 will be lighted in correspondence with areas of "hit" thereon by laser light pulses, the placement of which is contingent upon the shooting accuracy of marksman 9. In the exemplary situation being discussed, indicator light 101 would go on, thereby notifying marksman 9 that his shot was high and right relative to the bullseye of target 18.

From the foregoing explanation and inspection of the ROM truth table of FIG. 2, it may readily be appreciated that a bullseye "hit" would cause indicator light 97 to light and near misses would cause other indicator lights to light up in accordance with the general areas of "miss", respectively.

The aforementioned bullseye "miss" information provided by the indicator lights of target 18 facilitates the taking of corrective aiming action by marksman 9, thereby enabling him to learn to shoot some particular gun (or other weapon) in a safe and expeditious manner.

Although the preceding discussion describes the operation of those elements of the invention which actually cause the proper "hit" indicator light to be turned on in correspondence with the aiming of gun 11 by marksman 9, in order for the various and sundry components of the combination thereof to function in a timely manner, a programmer 66, consisting of NOR gate 67, delay timer 69, readout timer 71, and reset timer 73, has been included in the subject invention, for it has been found that it vastly improves the performance thereof, especially in comparison with that of the Universal Infantry Weapons Trainer of the aforementioned prior art U.S. Pat. No. 3,964,178 to Marshall et al.

Thus, to optimize the invention, each of the outputs of latches 45, 51, 57, and 63 is connected to an input of NOR gate 67, which, in turn, permits any input signal supplied thereto from latches 45, 51, 57, and 63 to start the timing chain of operation without interference of any of the others unless they, too, have been activated. Hence, upon receipt of an input signal from any one or more of channels I through IV, NOR gate 67 produces an output signal which initiates the delay period effected by delay timer 69, the delay period of which should be preset such as to permit the settling down of all the logic circuits in the invention at the right time. After the expiration of said settling down (or dead time) period, delay timer 69 produces an output signal which is supplied to the input of the readout timer, the latter of which has been preset to produce two output signals, viz., a ROM enable signal, and a reset timer trigger signal. The ROM enable signal is supplied to the "dump" input of ROM 65, so that after a predetermined period of time ROM 65 reads out whatever data was stored therein as a result of its previously and timely reading the four channel inputs thereto; and the reset timer trigger signal (which may be the same as the aforementioned enable signal) is supplied to reset timer 73 which, in turn, has been preset to effect the timely resetting of latches 45, 51, 57, and 63, so that they will be ready for the next cycle and, thus, the input signals supplied thereto that are caused by the next firing of gun 11 by marksman 9. Of course, the resetting of latches 45, 51, 57, and 63 occurs a predetermined time after ROM 65 has been read out, because reset timer 73 has been preset to properly time the respective operations thereof. Of course, as previously mentioned, the enabling of ROM 65 and the resulting reading out thereof causes the appropriate ones of target indicator lights 115 to be lighted for enough time for marksman 9 (and perhaps others, as well) to observe them in preparation for taking whatever corrective aiming is required to improve the accuracy of the next shot.

As also previously mentioned, channels I, III, and IV and all of the elements associated therewith work just like channel II (and said associated elements). Of course, as may readily be seen from the truth table of FIG. 2, one or any other number of channels may be operative at any given time—that is, during any given firing cycle. Accordingly, either a "hit" or general area of "miss" is displayed at target 18 by the corresponding light of indicating lights 115.

Moreover, as previously suggested, if so desired, any suitable telemetering system 117—including wires, radio, or the like—may optionally be employed in conjunction with target display monitor 119 for the purpose of facilitating the monitoring of target 18 by marksman 9 (or others), in the event target 18 and marksman 9 are quite far apart and indicator lights 115 are not as visible as he would like.

From the foregoing, it may readily be seen that the subject invention comprises a new, unique, and exceedingly useful marksman training and target system which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A target system for indicating the general area of a radiant energy hit thereon, comprising in combination:

a target having a predetermined indicia mounted thereon;

a plurality of predetermined indicator means mounted on said target, with one thereof mounted at the center of said target, and with the remainder thereof mounted uniformly around the perimeter of said target;

a quartet of sensors, each of which is adapted for producing an electrical signal in response to receiving said radiant energy, and all of which are relatively disposed in a quadrant pattern, the pattern of which is disposed a predetermined distance from said predetermined indicator means mounted at the center of said target;

a quartet of data processing channels effectively connected to the outputs of said quartet of sensors for producing predetermined signals at the data outputs thereof in response to said electrical signals, respectively;

a predetermined programmed read only memory having a quartet of data inputs, an enable input, and a plurality of outputs, with the quartet of data inputs thereof respectively connected to the data outputs of said quartet of data processing channels, and with the plurality of outputs thereof effectively connected to the inputs of said plurality of predetermined indicator means;

a NOR gate, having a quartet of inputs effectively connected to the outputs of said quartet of data processing channels and an output;

an adjustable delay timer connected to the output of said NOR gate;

an adjustable readout timer having a data input, a data output, and an enable output, with the data input connected to the output of said adjustable timer, and the enable output connected to the enable input of said predetermined programmed read only memory for timely enabling said read only memory, so as to effect the reading out of the data stored in said read only memory, thereby effecting the activation of said plurality of predetermined indicator means in correspondence therewith; and an adjustable reset timer having an input connected to the output of said adjustable readout timer, and an output effectively connected to the reset inputs of said quartet of data processing channels for timely resetting said data processing channels.

2. The device of claim 1, wherein said radiant energy is a predetermined laser light.

3. The device of claim 1, wherein each of said plurality of predetermined indicator means mounted on said target comprises an electric light.

4. The device of claim 1, wherein each of said quartet of sensors comprises a photodiode.

5. The device of claim 1, wherein each of said quartet of data processing channels comprises:

an amplifier;

a comparator having a pair of inputs and an output, with one of the inputs thereof connected to the output of said amplifier, and with the other input thereof connected to a positive direct current voltage; and a latch having a data input, a reset input, and an output, with the data input thereof connected to the output of the aforesaid comparator.

6. The device of claim 1, wherein said predetermined programmed read only memory comprises means for performing functions in accordance with following truth table:

for a 1, 1, 1, 1 word supplied to the data inputs thereof, a first analog signal representing a target bullseye emanates therefrom in response to an enabling signal supplied thereto;

for a 0, 1, 0, 0 word supplied to the data inputs thereof, a second analog signal representing a high right target hit signal emanates therefrom in response to an enabling signal supplied thereto;

for a 1, 0, 0, 0 word supplied to the data inputs thereof, a third analog signal representing a high left target hit signal emanates therefrom in response to an enabling signal supplied thereto;

for a 1, 1, 0, 0 word supplied to the data inputs thereof, a fourth analog signal representing a high target hit signal emanates therefrom in response to an enabling signal supplied thereto;

for a 0, 0, 0, 1 word supplied to the data inputs thereof, a fifth analog signal representing a low left target hit signal emanates therefrom in response to an enabling signal supplied thereto;

for a 0, 0, 1, 0 word supplied to the date inputs thereof, a sixth analog signal representing a low right target hit signal emanates therefrom in response to an enabling signal supplied thereto;

for a 1, 0, 0, 1 word supplied to the data inputs thereof, a seventh analog signal representing a left target hit signal emanates therefrom in response to an enabling signal supplied thereto;

for a 0, 1, 1, 0 word supplied to the data inputs thereof, an eighth analog signal representing a right target hit signal emanates therefrom in response to an enabling signal supplied thereto; and for a 0, 0, 1, 1 word supplied to the data inputs thereof, a ninth analog signal representing a low target hit signal emanates therefrom in response to an enabling signal supplied thereto.

7. The invention of claim 1, further characterized by a plurality of timers respectively connected between the plurality of outputs of said read only memory and the inputs of the aforesaid plurality of predetermined indicator means.

8. The invention of claim 1, further characterized by a predetermined radiant energy filter contiguously disposed in front of the radiant energy receiving inputs of the aforesaid quartet of sensors.

9. The device of claim 8, wherein said filter comprises a sunlight filter.

10. A practice target system for indicating the general area of radiant energy impact thereon, comprising in combination:

a target having a predetermined indicia mounted thereon;

nine lights mounted on said target, with one thereof mounted at the center of the face thereof, and with the remaining eight thereof mounted substantially uniformly around the effective perimeter of said target;

first, second, third, and fourth photodiodes disposed in quadrant arrangement with respect to each other;

a first amplifier connected to the output of said first photodiode;

a first comparator having a pair of inputs and an output, with one of the inputs thereof connected to the output of said first amplifier;

a first latch having a pair of inputs and an output, with one of the inputs thereof connected to the output of said first comparator;

a second amplifier connected to the output of said second photodiode;

a second comparator having a pair of inputs and an output, with one of the inputs thereof connected to the output of said first amplifier;

a second latch having a pair of inputs and an output, with one of the inputs thereof connected to the output of said second comparator;

a third amplifier connected to the output of said third photodiode;

a third comparator having a pair of inputs and an output, with one of the inputs thereof connected to the output of said third amplifier;

a third latch having a pair of inputs and an output, with one of the inputs thereof connected to the output of said third comparator;

a fourth amplifier connected to the output of said fourth photodiode;

a fourth comparator having a pair of inputs and an output, with one of the inputs thereof connected to the output of said fourth amplifier;

a fourth latch having a pair of inputs and an output, with one of the inputs thereof connected to the output of said fourth comparator;

a NOR gate having first, second, third, and fourth inputs respectively connected to the outputs of the aforesaid first, second, third, and fourth latches;

an adjustable delay timer connected to the output of said NOR gate;

an adjustable readout timer having an input and a pair of outputs, with the input thereof connected to the output of said adjustable delay timer;

an adjustable reset timer having an input and an output, with the input thereof connected to the output of the aforesaid adjustable readout timer, and with the output thereof connected to the other inputs of the aforesaid first, second, third, and fourth latches;

a direct current voltage connected to the other inputs of the aforesaid first, second, third, and fourth comparators;

a read only memory having four data inputs, one enable input, and nine outputs, with the four data inputs thereof respectively connected to the outputs of the aforesaid first, second, third, and fourth latches, and with the enable input thereof connected to the other output of the aforesaid adjustable readout timer; and nine delay timers respectively connected between the nine outputs of said read only memory and the nine inputs of the aforesaid nine lights.

11. The device of claim 10, wherein said read only memory includes means for performing data processing functions in accordance with the following truth table:

for a 1, 1, 1, 1 word supplied to the data inputs thereof, a first analog signal representing a target bullseye emanates therefrom in response to an enabling signal supplied thereto;

for a 0, 1, 0, 0 word supplied to the data inputs thereof, a second analog signal representing a high right target hit signal emanates therefrom in response to an enabling signal supplied thereto;

for a 1, 0, 0, 0 word supplied to the data inputs thereof, a third analog signal representing a high left target hit signal emanates therefrom in response to an enabling signal supplied thereto;

for a 1, 1, 0, 0 word supplied to the data inputs thereof, a fourth analog signal representing a high target hit signal emanates therefrom in response to an enabling signal supplied thereto;

for a 0, 0, 0, 1 word supplied to the data inputs thereof, a fifth analog signal representing a low left target hit signal emanates therefrom in response to an enabling signal supplied thereto;

for a 0, 0, 1, 0 word supplied to the data inputs thereof, a sixth analog signal representing a low right target hit signal emanates therefrom in response to an enabling signal supplied thereto;

for a 1, 0, 0, 1 word supplied to the data inputs thereof, a seventh analog signal representing a left target hit signal emanates therefrom in response to an enabling signal supplied thereto;

for a 0, 1, 1, 0 word supplied to the data inputs thereof, an eighth analog signal representing a right target hit signal emanates therefrom in response to an enabling signal supplied thereto; and for a 0, 0, 1, 1 word supplied to the data inputs thereof, a ninth analog signal representing a low target hit signal emanates therefrom in response to an enabling signal supplied thereto.

12. The system of claim 10, further characterized by an optical filter means contiguously disposed with and in front of the optical inputs of said first, second, third, and fourth photodiodes.

13. The system of claim 10, further characterized by:

a target monitor display means, having a readout face that is substantially identical to that of the aforesaid target, adapted for being spatially disposed from said target; and telemetering means connected between outputs of said target and inputs of said target monitor display means for effecting duplicate readouts thereof.

14. A system for training a marksman to shoot a weapon accurately comprising in combination:

a target having predetermined indicia mounted thereon;

a plurality of indicator lights mounted on said target, with one thereof mounted at the center of the front face of said target, and the remainder thereof mounted uniformly around said one thereof at a predetermined distance therefrom;

sensor means mounted on said target in close proximity with the light mounted at the center of said target, said sensor means including a quartet of photodiodes, each photodiode of which produces an electrical output signal in proportion to the amount of a predetermined frequency laser light received at the optical input thereof;

a plurality of thresholder means effectively and respectively connected to the outputs of the photodiodes of said sensor means for producing output pulses only when the electrical output signals produced by said photodiodes exceed a predetermined voltage level;

a plurality of latch means, each of which has a data input, a reset input, and a data output, with data inputs of said plurality of latch means effectively and respectively connected to the outputs of said plurality of threshold means for producing data signals at the data outputs thereof only when the data inputs thereof are triggered by the output pulses produced by said thresholder means;

read only memory means, having a plurality of data inputs effectively and respectively connected to the data outputs of said plurality of latch means, a plurality of data outputs effectively and respectively connected to the inputs of said plurality of target mounted indicator lights, and an enable input for performing an analysis of the data signals produced by said plurality of latch means in accordance with a predetermined program, and for providing an analog signal at one of the plurality of outputs of said read only memory means in accordance with the analysis of said data signals performed by said predetermined program so as to enable one of said plurality of indicator lights;

gating means having a plurality of inputs effectively connected to the outputs of said plurality of latch means and an output for producing an output signal whenever one of the data signals produced by said plurality of latch means appears at one of the plurality of inputs of said gating means; and timing means having an input connected to the output of said gating means, an enable output connected to the enable input of said read only memory means, and a reset output connected to the reset inputs of said plurality of latch means for timely resetting said plurality of latch means in response to the output signal produced by said gating means, and for timely enabling said read only memory means in response to the output signal produced by said gating means so as to effect the lighting of one said plurality of lights in correspondence with the analog signal provided by said read only memory means.

15. The system of claim 14, further characterized by an optical filter contiguously disposed with and in front of the optical inputs of said quartet of photodiodes of said sensor means for stopping substantially all radiant energy frequencies ambient thereto but passing said predetermined frequency laser light.

16. The system of claim 14, further characterized by a laser rifle spatially disposed from said target for shooting said predetermined frequency laser light thereat when triggered by said marksman.

17. The system of claim 16, further characterized by a focusing lens effectively connected to the projection output of said laser rifle for focusing the predetermined frequency laser light shot therefrom.

18. The system of claim 14, wherein said gating means comprises a NOR gate.

19. The system of claim 14, wherein said timing means comprises an adjustable delay timer having an input connected to the output of said gating means and an output;

an adjustable read out timer having an input connected to the output of said adjustable delay timer and an output; and an adjustable reset timer having an input connected to the output of said adjustable readout timer.

* * * * *